United States Patent [19]

Dyck et al.

[11] 4,419,918

[45] Dec. 13, 1983

[54] SYNCHRONIZING SIGNAL GENERATOR AND AN ELECTRONIC MUSICAL INSTRUMENT USING THE SAME

[75] Inventors: Ralph Dyck; Peter Dunick, both of Vancouver, Canada

[73] Assignee: Roland Corporation, Osaka, Japan

[21] Appl. No.: 343,091

[22] Filed: Jan. 27, 1982

[30] Foreign Application Priority Data

Feb. 17, 1981 [JP] Japan ..... 56-23651

[51] Int. Cl.[3] ..... G10H 1/40

[52] U.S. Cl. ..... 84/1.03; 84/1.28; 84/DIG. 11; 84/DIG. 12; 84/DIG. 29; 328/16; 328/18; 328/59; 328/62; 364/419; 364/761

[58] Field of Search ..... 84/1.01, 1.03, 1.28, 84/DIG. 11, DIG. 12, DIG. 29; 364/761, 419; 328/14–18, 59, 62

[56] References Cited

U.S. PATENT DOCUMENTS

| | | | |
|---|---|---|---|
| 4,085,645 | 4/1978 | Ryon | 84/1.01 |
| 4,328,731 | 5/1982 | Gotho et al. | 84/1.01 |
| 4,333,374 | 6/1982 | Okumura et al. | 84/1.01 |

*Primary Examiner*—S. J. Witkowski

*Attorney, Agent, or Firm*—W. G. Fasse; D. H. Kane, Jr.

[57] ABSTRACT

A synchronizing signal generator includes a tape recorder which is adapted to record click signals in response to actuations of a manual switch. Counting clock signals go on while the click recorded signals are reproduced, especially during a length of time extending from receipt of a particular one of the click signals to receipt of the next succeeding click signal. The resultant count is divided by a given numeral value and then the quotient is stored. The clock signals developing between the respective click signals are further counted during the course of reproduction of the click signals from the tape recorder and a pulse signal is delivered whenever the instantaneous count coincides with the stored quotient. Tempo clock signals are obtained through the division of the pulse signal at a selected division ratio out of a plurality of division ratios. The tempo clock signals are fed to a sequencer which in turn generates a control voltage and gate signals synchronous with the tempo clock signals. A music synthesizer produces tone signals in synchronism with said tempo clock signals in response to the control voltage and the gate signals.

22 Claims, 10 Drawing Figures

SYNCHRONIZING SIGNAL GENERATOR AND AN ELECTRONIC MUSICAL INSTRUMENT USING THE SAME

BACKGROUND OF THE INVENTION

Field of the Invention

This invention relates to a synchronizing signal generator and an electronic musical instrument equipped with such a signal generator. More particularly, the invention pertains to a synchronizing signal generator for generating synchronizing signals such as tempo clock signals in synchronism with the pulse signal generated through manual operation of a switch, and an electronic musical instrument for producing musical tones or sounds at a tempo synchronous with the synchronizing signals.

Musical performances in studios are usually recorded by the multiplex-recording method wherein a family of musical instruments is divided into several groups which are individually and sequentially recorded on a magnetic tape having a plurality of recording tracks with a tape recorder or the like, instead of recording at one time all of the musical instruments being played simultaneously. In the former method, a rhythm instrument is first played for recording on a particular one of the tracks on the magnetic tape and the remaining instruments are played at a tempo corresponding to the rhythm reproduced from the tape for recording sounds in sequence on the remaining tracks of the magnetic tape.

Another example of the recording of musical performances is that a musical instrument is played by the player while he is listening to rhythm sounds generated from an automatic rhythm generator based on a live performance or on a reproduction from the tape, and musical tones or sounds of the instrument are recorded on one of the tracks of the magnetic tape and musical sounds of other musical instruments are recorded on the remaining tracks of the magnetic tape. This method of musical sound recording however gives the listener an unagreeable mechanical feeling because the rhythm of the automatic rhythm generator is too accurate and punctual.

An approach to avoid the above disadvantage demands that the tempo of the automatic rhythm generator follows delicate variations in the tempo of playing the other instruments. To this end adjustments of the tempo of the automatic rhythm generator should be achieved mainly through manual operation of a knob of a tempo regulator, which operation is very difficult.

Furthermore, an automatic player has been proposed in which a musical tune or piece of music is programmed in a computer and musical sounds are delivered from a music synthesizer under control of the computer. Even when the musical sounds from the automatic player are recorded, great difficulty is experienced in bringing the tempo of the automatic player into agreement with the tempo of the other musical instruments as in the case with the automatic rhythm generator stated previously.

SUMMARY OF THE INVENTION

According to the present invention, a given number of synchronizing signals are developed during a length of time elapsed between the receipt of a particular pulse signal and the receipt of the next pulse signal. In other words, clock signals are counted by counting means during a length of time from the point where the particular pulse signal is received at an input terminal to the point where the next succeeding pulse signal is received. The count obtained during said length of time or the quotient resulting from the division of the count by a predetermined numeral value is stored in storage means. Said counting means provide an output signal when certain coincidence conditions are satisfied as will be described below. Furthermore, tempo clock signals may be developed through the division of the synchronizing signals delivered by the synchronizing signal generator. An electronic musical instrument, supplied with the tempo clock signals, may generate musical tones at a tempo synchronous with the synchronizing signals.

In a preferred embodiment of the present invention, when a manual switch or a foot switch is actuated in timed relationship with the tempo of musical sounds being reproduced from a magnetic tape or a musical piece being actually played, the tempo clock signals may be developed in synchronism with that tempo. Upon actuation of a tempo switch such as said manual or foot switch, the pulse signals are provided and recorded on a particular one of tracks of a magnetic tape. The pulse signals are reproduced from the magnetic tape and the clock signals are counted between the respective pulse signals. The resultant count is divided by a numeral value which is necessary for dividing the interval of the respective pulse signals into a desired number of time slots and the instantaneous quotients are stored sequentially in said storage means. If the pulse signals are reproduced and the clock signals are received with the number thereof equal to the quotient fetched from said storage means, then the output signal is delivered. It is possible that the above division may be performed to evaluate the quotient after the count has been stored in said storage means. A desired number of the tempo clock signals may be developed between the particular pulse signal and the following pulse signal by dividing the output signals to acheive a given division ratio. The tempo clock signals are supplied to a sequencer which in turn provides a control voltage and gate signals synchronous with the tempo clock signals for a music synthesizer for the development of tone signals. In this manner, the desired tempo clock signals are made available upon actuation of the manual switch or the foot switch. Since the tone signals so developed are dependent upon the tempo as determined by the manual operation, musical sounds defined by the tone signals offer the effect of live performances with subtle variations in tempo without giving a mechanical impression.

In addition, in the preferred embodiment of the present invention, rhythm sounds may be delivered at a tempo synchronous with the tempo clock signals when the tempo clock signals are applied to the automatic rhythm generator. Therefore, this makes it possible to bring the tempo as determined by the rhythm of the automatic rhythm generator into agreement with the tempo of playing the other musical instruments and to automatically deliver rhythm sounds with delicate variations in tempo as if a human would play the musical instruments.

In the preferred embodiment of the present invention, the tempo clock signals frequency divided at different division ratios are selectable from frequency dividing means which divide the output signal of said counting means. The number of the clock signals developed between the particular pulse signal and the next succeeding pulse signal is therefore selectable optionally.

Moreover, provided that the preferred embodiment of the present invention is further adapted such that the number of the output signals supplied to said frequency dividing means during the length of time from the time where the particular pulse signal is applied to the time where the next pulse signal is applied is variable, it is also possible to advance and retard the development of the tempo clock signals. In other words, the length of time between the particular pulse signal and the next pulse signal may be finely adjustable. This allows a fine adjustment of the rhythm of automatic play through manual operation. In particular, even though the tempo clock signals may fail to meet a timed relationship with the synchronizing signals due to a running error caused when the magnetic tape is running, it is also easy to offset the phase difference between the synchronizing signals and the tempo clock signals by varying the number of the output signals to be supplied to said frequency dividing means.

Accordingly, it is a primary object of the present invention to provide a synchronizing signal generator capable of generating a desired number of synchronizing signals during a length of time from a point of time where a particular pulse signal is applied to the point of time where the next succeeding pulse signal is applied.

It is another object of the present invention to provide an electronic musical instrument wherein a desired number of synchronizing signals may be generated during a the above mentioned length of time and to produce tempo clock signals based upon the synchronizing signals for reproducing musical tones or sounds at a tempo as if a human would play the instrument.

It is still another object of the present invention to provide an electronic musical instrument wherein the development of tempo clock signals is advanced or retarded to allow fine adjustments of the length of a beat and a musical tune or piece of music is produced at a playing tempo in synchronism with the synchronizing signals.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS AND OF THE BEST MODE OF THE INVENTION

Figure 1:
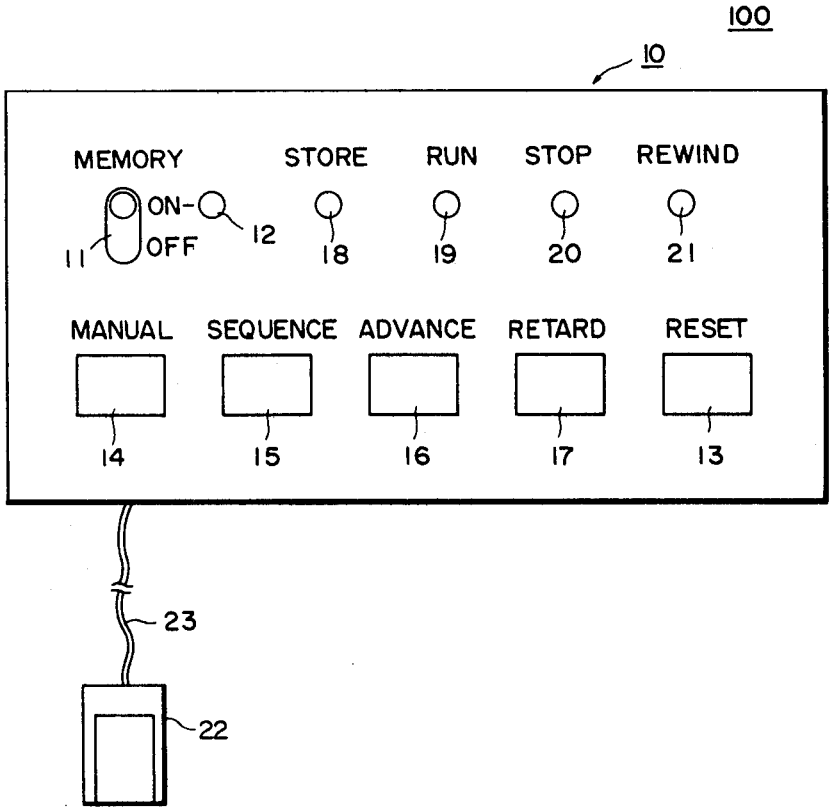
FIG. 1 is a view showing the outer appearance of an operational panel in an embodiment of the present invention.

FIG. 1 is a view showing the outer appearance of an operational panel 10 according to an embodiment of the present invention. A synchronizing signal generator 100 will now be described with reference to FIG. 1. The synchronizing signal generator 100 includes the operational panel 10. The operational panel 10 is provided with a memory switch 11, a reset switch 13, a manual switch 14, a sequence switch 15, an advance switch 16, a retard switch 17 and light emitting diodes 12, 18 to 21 for indicating the operational state as shown.

The memory switch 11 is provided to determine whether data are allowed to be stored in a memory 114 as described below with reference to FIG. 2. The reset switch 13 places the synchronizing signal generator 100 into a reset state. The manual switch 14 is adapted to give an instruction for the development of pulses when being manually actuated by the player while he is listening to sounds from a percussion instrument being actually played.

Disposed at a distance from the operational panel 10 is a foot switch 22 which issues an instruction for the development of the pulses when the player holds an instrument with his hands and steps on the foot switch. The foot switch 22 is connected by conductor wires 23 to the operational panel 10 of the synchronizing signal generator 100. The sequence switch 15 is adapted to issue an instruction for proceeding with further steps when a central processing unit CPU 105 of FIG. 2 executes an operation pursuant to a program. The advance switch 16 is actuated when it is desired to accelerate the tempo clock signals and the retard switch 17 is actuated when it is desired to decelerate the tempo clock signals.

The light emitting diode 12 indicates to a player that it becomes possible to maintain the data in a memory 114 when the memory switch 11 is turned ON. The light emitting diode 18 (STORE display) indicates that a step is in process for issuing an instruction for counting clock signals with the CPU 105 or for loading numerical data resulting from divisions, into the memory 114. The light emitting diode 19 (RUN display) shows that the CPU 105 proceeds with a step for delivering output pulse signals. The light emitting diode 20 (STOP display) indicates that the output pulse signals are inhibited from being delivered. The light emitting diode 21 (REVIEW display) indicates that the rewinding of the magnetic tape is requested after the memory 114 has been loaded with the numeral data.

Figure 2:
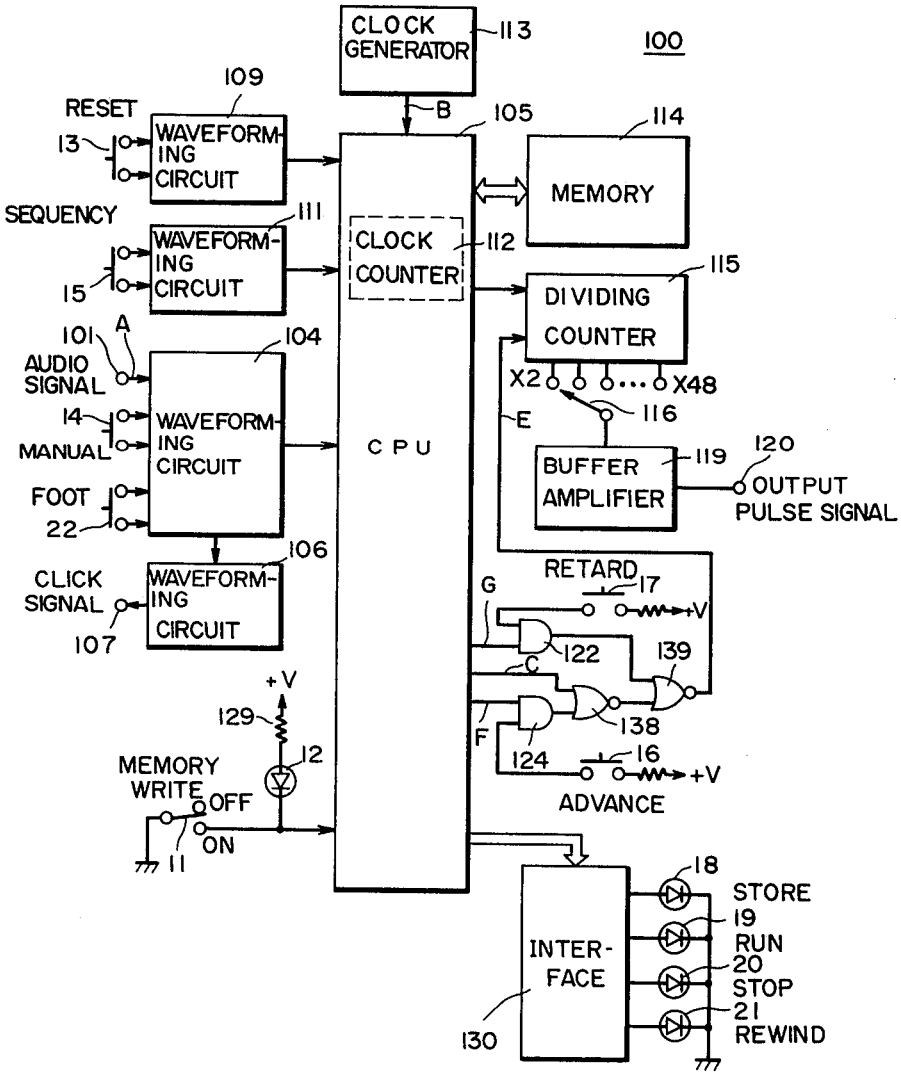
FIG. 2 illustrates a block diagram of an embodiment of a synchronizing signal generator circuit of the present invention.

FIG. 2 is a schematic block diagram of the illustrated embodiment of the present invention. An audio signal input terminal 101 is connected to receive from such an external equipment as a tape recorder pulse signals which define a rhythm tempo (referred to as "click signals" hereinafter). The click signals received are shaped via a waveforming circuit 104 and fed into the CPU 105. Both the manual switch 14 and the foot switch 22 are connected to the waveforming circuit 104.

The waveforming circuit 104 not only shapes the above mentioned click signals received by the audio signal input terminal 101 but also produces the click signals whenever the manual switch 14 or the foot switch 22 are closed. The click signals are fed to the CPU 105 and to a waveforming circuit 106 for shaping the click signals to have a given pulse width and leads the resultant signals to a click signal output terminal 107 shown in FIG. 3 connected to a recording input terminal of a tape recorder. When the manual switch 14 or the foot switch 22 is actuated, the click signals may be recorded by the tape recorder. The click signals recorded on the magnetic tape are reproduced via the tape recorder and introduced as the rhythm tempo-defining signals the audio signal input terminal 101.

The reset switch 13 is connected to the waveforming circuit 109. When the reset switch 13 is in its closed position, the waveforming circuit 109 permits pulse signals of a given width to be supplied to the CPU 105 which in turn is ready to perform its first step. The sequence switch 15 is connected to a waveforming circuit 111 which generates a pulse signal and supplies the same to the CPU 105 whenever the sequence switch 15 is closed.

The CPU 105 includes a clock oscillator 113 connected thereto for generating the clock signals. A clock counter 112 is provided within the CPU 105. When the manual switch 14, for example, is actuated and the click signals are fed from the waveforming circuit 104 to the CPU 105, the clock counter 112 counts the clock signals from the clock oscillator 113 pursuant to a programmed operation. During a length of time from the point where a particular one of the click signals is received to the point where the next succeeding click signal is received after the passage of a fixed period of time, the CPU 105 divides the count of the clock counter 112 by a predetermined numeral value (for example 96). This numeral value is selected merely to obtain a desired number of the pulses and should not be limited to 96.

A memory 114 is operatively associated with the CPU 105 to store the result of the division (quotient). After the result of the division (quotient) has been loaded into the memory 114, the CPU 105 permits the counting of the clock signals by the clock counter 112 upon application of the click signals from the waveforming circuit 104. The CPU 105 compares the count of the clock counter 112 with the numeral data (quotient) stored in the memory 114 and, if both agree, provides an output pulse signal E for a dividing counter 115 through NOR gates 138 and 139. The dividing counter 115 is supplied with a reset signal from the CPU 105 when the reset switch 13 is actuated.

The dividing counter 115 divides at different division ratios (typically, $\frac{1}{2}$ to 1/48) the output pulse signal received from CPU 105 for the development of tempo clock signals and has output terminals for delivering respectively $\frac{1}{2}$ to 1/48 division outputs. These output terminals are connected to a time base selector 116 which serves as a division ratio selector. To obtain a desired number of the pulses, the time base selector 116 is actuated to select any one of the different division outputs of the dividing counter 115. The selected one of the divider outputs from the time base selector 116 is fed to a buffer amplifier 119. The buffer amplifier 119 delivers at its output terminal 120 the divider output representing the tempo clock signal selected through the time base selector 116. This output pulse signal is supplied to a sequencer 300 described below with reference to FIG. 3.

The retard switch 17 is connected to an input to an AND gate 122. The other input to the AND gate 122 comprises a gate signal G from CPU 105 for inhibiting one of a plurality of pulse signals E from the CPU 105 from being fed to the dividing counter 115. Accordingly, when the retard switch 17 is closed, a NOR gate 139 is closed only for the period of a single pulse.

The advance switch 16 is connected to an input to an AND gate 124. The other input to the AND gate 124 comprises an addition pulse signal F from the CPU 105. The addition pulse signal F is delivered from the CPU 105 once during the length of time from the point of time where a particular one of the click signals is received by the CPU 105 to the point of time where the next click signal is received. As a result, if the advance switch 16 is closed, then the AND gate 124 is opened to admit the addition pulse signal F into a NOR gate 138. The addition pulse signal F is added through the NOR gate 138 to the pulse signal E from the CPU 105.

The memory switch 11 has a common contact grounded and an ON contact connected to the CPU 105 to provide a power supply +V through a series circuit of the light emitting diode 12 and a resistor 129. The CPU 105 is programmed to permit the rewriting of data in the memory 114 when the memory switch 11 is turned ON for supplying the CPU 105 with a "L" level signal.

An interface 130 enables and disables the light emitting diodes 18 to 21 as illustrated in FIG. 1 in response to the instructions from the CPU 105.

Figure 3:
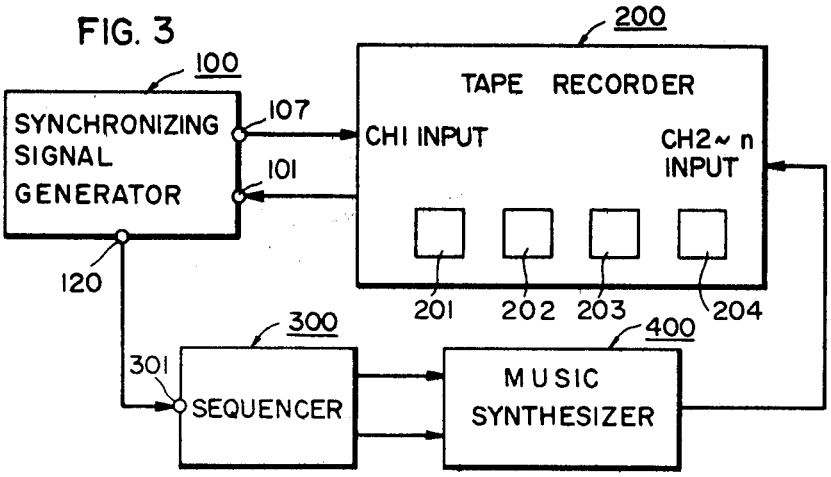
FIG. 3 is a schematic block diagram illustrating an example of an arrangement for enabling a music synthesizer to produce tone signals by using a synchronizing signal generator as shown in FIG. 2.

FIG. 3 illustrates a schematic block diagram of an arrangement for enabling a music synthesizer to conduct automatic play as an example of an application of the synchronizing signal generator 100 of FIGS. 1 and 2 for enabling an electronic musical instrument to play automatically for tape recording. The output terminal 107 of the synchronizing signal generator 100 of FIG. 1 for delivering the output pulse signals is connected to a first channel record signal input terminal of the tape recorder 200. A reproduction signal output terminal of the tape recorder 200 is connected to the audio signal input terminal 101 of the synchronizing signal generator 100.

Further, the output pulse signal output terminal 120 of the synchronizing signal generator 100 is connected to a synchronizing signal input terminal 301 of a sequencer 300. As will be described in detail with regard to FIG. 4, the sequencer 300 is constructed to produce a control voltage and gate signals which are in synchronism with the tempo as determined by the output pulse signals derived from the synchronizing signal generator 100. The control voltage and the gate signals resulting from the sequencer 300 are supplied to the music synthesizer 400. In response to the control voltage and the gate signals applied thereto, the music synthesizer 400 generates tone signals in synchronism with the output pulse signals from the synchronizing signal generator 100 as will be made clear from FIG. 6. The tone signals are supplied to second to (n)th channel record signal input terminals of the tape recorder 200. The tape recorder 200 includes a play key 201, a fast forward key 202, a rewind key 203 and a record key 204.

Figure 4:
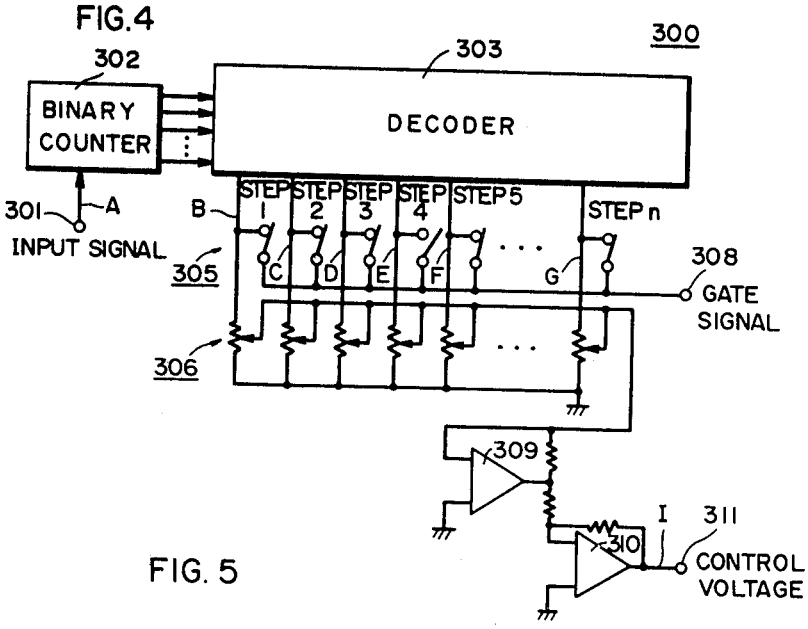
FIG. 4 is a block diagram illustrating in further detail a sequencer as shown in FIG. 3.

FIG. 4 is a schematic block diagram of the sequencer 300 as shown in FIG. 3. The input terminal 301 is supplied with the output pulse signals derived from the output 120 of the synchronizing signal generator 100 as the tempo clock signals. These output pulse signals are fed to an input terminal of a binary counter 302 which counts the output pulse signals and provides its count as a binary signal for a decoder 303. The decoder 303 has a plurality of output terminals from which the gate signals with an interval corresponding to the cycle of the output pulse signals are delivered in sequence. Each of the output terminals of the decoder 303 is connected to a gate switch 305 and a variable resistor 306. That is, each of the output terminals of the decoder 303 is connected to a contact terminal of the gate switch 305 and a terminal of the variable resistor 306.

The remaining contact terminals of the respective gate switches 305 are connected commonly to a gate signal output terminal 308. The gate switches 305 are adapted for manually introducing time settings for respective musical tones. Further, the respective variable resistors 306 are adapted for manually introducing pitch settings for the respective musical tones during each of the gate periods as set by the gate switches 305. The remaining terminals of the respective variable resistors 306 are grounded and the sliding terminals thereof are connected to a common input terminal of an amplifier 309. An output terminal of the amplifier 309 is connected to an input terminal of an amplifier 310 whose output terminal is connected to a control voltage output terminal 311.

Figure 5:
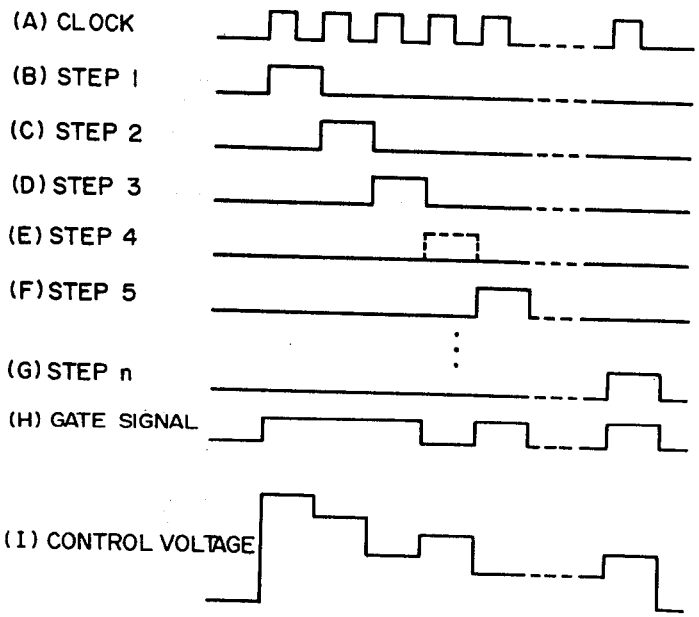
FIG. 5 is a waveform diagram illustrating various signals in the sequencer of FIG. 4.

FIG. 5 is a waveform diagram of various signals occurring in the sequencer 300 of FIG. 4. Operation of the sequencer 300 will be discussed briefly with reference to FIGS. 4 and 5. The binary counter 302 counts the pulse signals as indicated in FIG. 5(A) and feeds its count to the decoder 303. The decoder 303 decodes the count furnished by the binary counter 302 and delivers sequentially the gate signals with the interval corresponding to the cycle of the pulse signals as shown in FIG. 5(B) to 5(G). Under these circumstances the gate switches 305 for steps 1 to 3 and steps 5 and n are closed. The closed gate switches correspond to the time settings for the respective musical notes and the open gate switches correspond to rests or pauses. There are developed in succession at the gate signal output terminal 308 the gate signals corresponding to the gate periods determined by the gate switches 305 as seen from FIG. 5(H). On the other hand, upon manipulation of the variable resistors 306 the control voltage corresponding to the settings of the variable resistors 306 is fed into the amplifier 309 as seen from FIG. 5(I). The control voltage is amplified with the amplifiers 309 and 310 and delivered from the control voltage output terminal 311. The gate signals and control voltage are supplied from the sequencer 300 to the music synthesizer 400.

It is noted that the sequencer 300 of FIG. 4 develops the gate signals and the control voltage in an analog fashion. Instead of the sequencer 300 the circuit may be implemented by any other well-known suitable digital sequencer.

Figure 6:
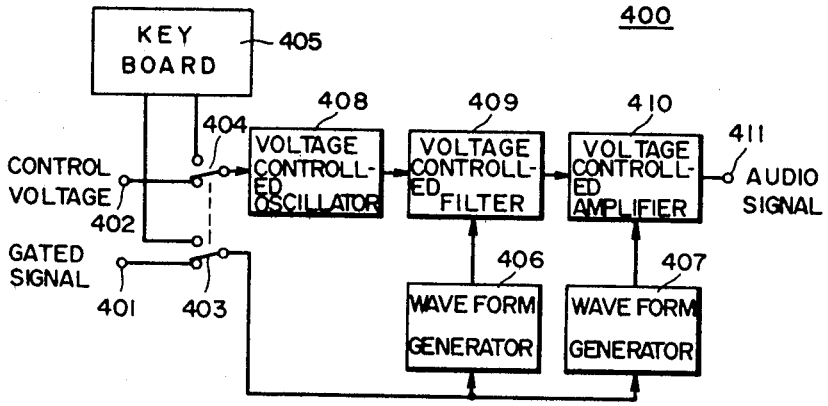
FIG. 6 is a schematic block diagram of the music synthesizer of FIG. 3.

FIG. 6 is a schematic block diagram of the music synthesizer 400 as shown in FIG. 3. Implementations and summarized operation of the music synthesizer 400 will be described by reference to FIG. 6. The music synthesizer 400 includes a gate signal input terminal 401 and a control voltage input terminal 402. The gate signals from the sequencer 300 are supplied to the gate signal input terminal 401 whereas the control voltage from the sequencer 300 is supplied to the control voltage input terminal 402. The gate signals received by the gate signal input 401 are fed to a contact of a switch 403, whereas the control voltage received by the control voltage input terminal 402 is fed to a contact of a switch 404. The other contact of the switch 403 receives a gate signal from a keyboard 405 and the other contact of the switch 404 receives a control voltage from the keyboard 405. The keyboard 405 includes a plurality of keys (not shown) for causing an automatic play through manual actuations of these keys. When respective keys on the keyboard 405 are actuated, the corresponding gate signals and the control voltage are developed. The changeover switches 403 and 404 are so operatively interlocked as to select alternatively the gate signals and the control voltage from the keyboard 405 or those from the sequencer 300. In the illustrated embodiment, the tone signals are generated based on the gate signals and the control voltage derived from the sequencer 300 rather than those from the keyboard 405. The gate signals selected by the changeover switch 403 are supplied to waveform generators 406 and 407 whereby the desired voltage waveform signals are provided. The voltage waveform signals generated by the waveform generator 406 are fed into a voltage-controlled filter circuit 409, whereas the voltage waveform signals produced by the waveform generator 407 are fed into a voltage-controlled variable gain amplifier 410.

The control voltage selected by means of the changeover switch 404 is supplied to a voltage-controlled oscillator 408 oscillating at a frequency varying as a function of the amplitude of the control voltage and serving as a sound source for the synthesizer 400. The output signal of the voltage-controlled oscillator 408 is fed to the voltage-controlled filter circuit 409 having a variable cut-off frequency in response to the voltage waveform signal from the waveform generator 406. The voltage-controlled filter circuit 409 cuts off at its cutoff frequency the harmonic components contained in the input signals applied thereto and modifies the harmonic structure showing a number of different harmonic overtones contained in the input signals. In other words, the voltage-controlled filter circuit 409 serves to vary its cutoff frequency and thus vary the tone quality of the input signals. The output signal of the voltage-controlled filter circuit 409 is supplied to the voltage-controlled variable gain amplifier 410 for controlling the level of the output signal of the voltage-controlled filter circuit 409 as a function of the control voltage waveform signal generated by the waveform generator 407. The output signal of the voltage-controlled variable gain amplifier 410 is derived as tone signals from an audio signal output terminal 411. Upon receipt of the control voltage the voltage-controlled oscillator 408 generates source signals according to the amplitude of the control voltage applied thereto. Tone signals are not produced by the music synthesizer 400 in the absence of the gate signals, in other words, tone signals are not produced in the presence of source signals corresponding to the remainders of the waveforms as specified by the open gate switches 305, because the voltage-controlled variable gain amplifier 410 does not receive any control voltage waveform signal from the waveform generator 407.

Figure 7:
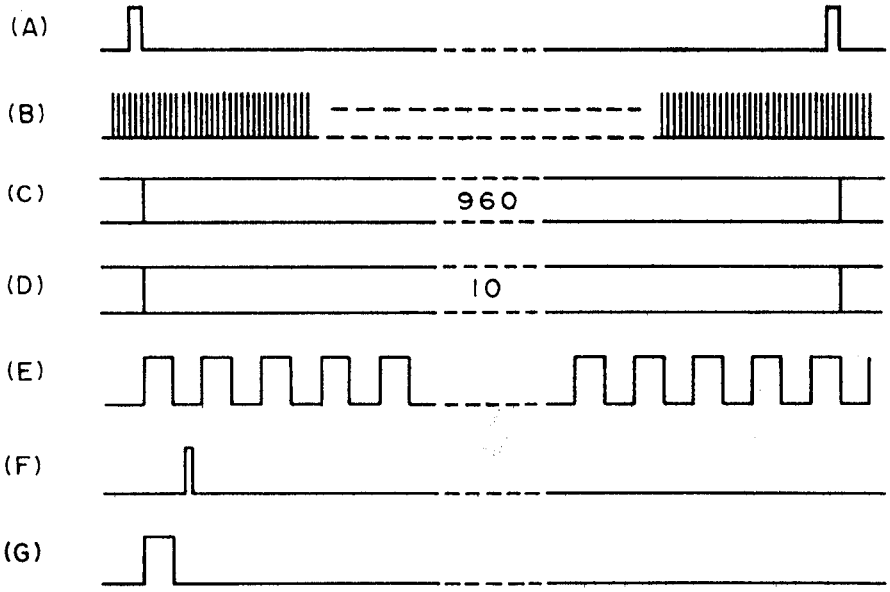
FIG. 7 is a waveform diagram of various signals occurring within the synchronizing signal generator as shown in FIG. 2.
Figure 8A:
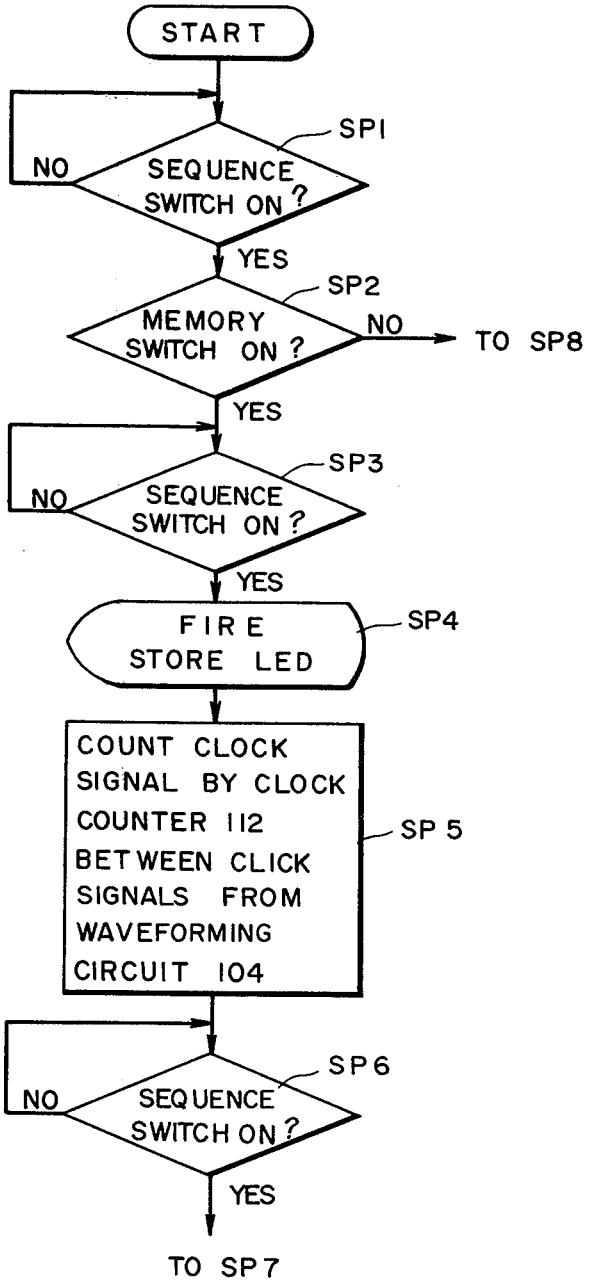
FIG. 8A and FIG. 8B are flow charts for explaining in detail operation of the illustrated embodiment of the present invention.
Figure 8B:
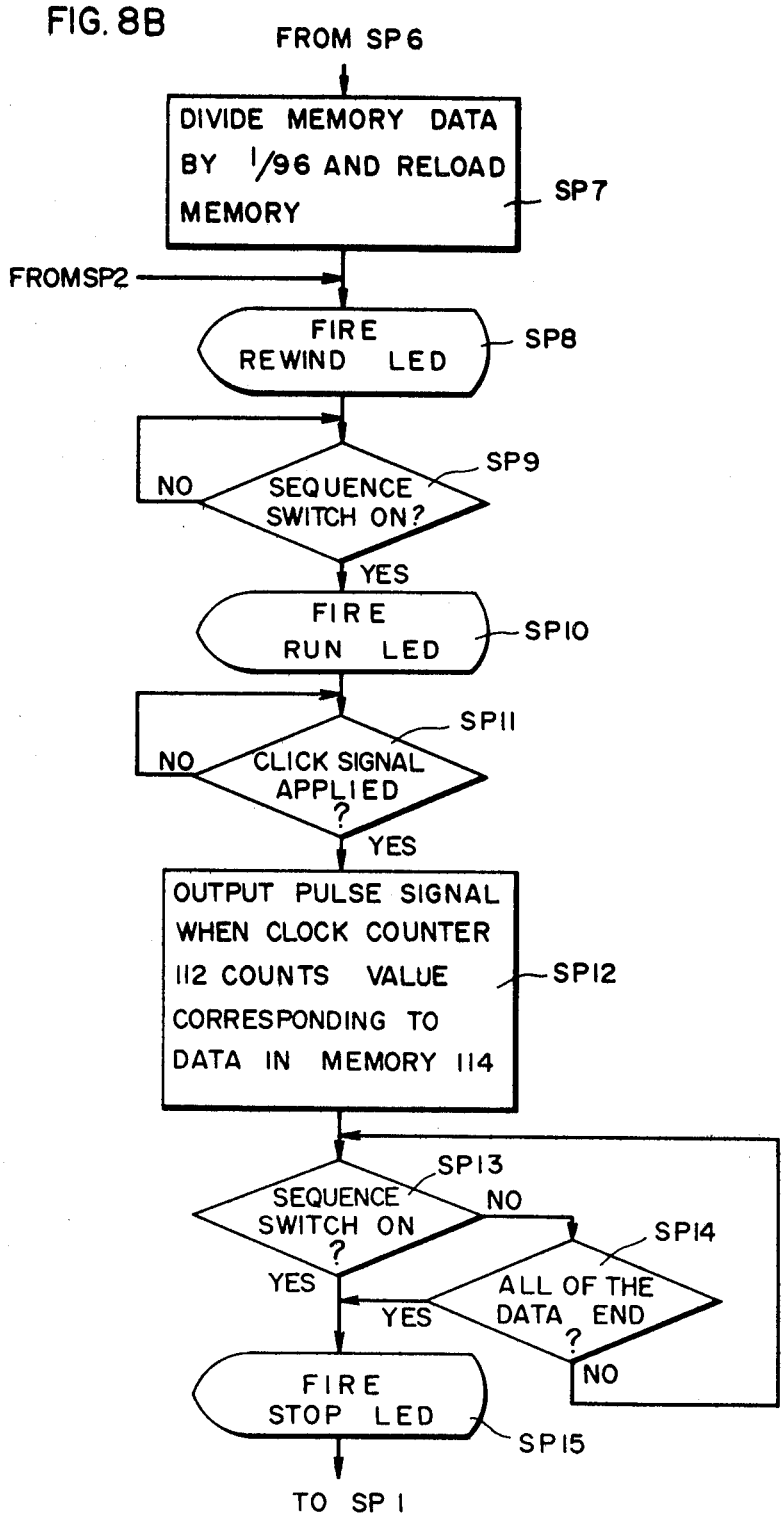

FIG. 7 is a waveform diagram of the signals coming from various points in the synchronizing signal generator 100 of FIG. 2 in operation. FIG. 8A and FIG. 8B are flow charts for explaining the operation of the illustrated embodiment of the present invention.

The operation of the illustrated embodiment of the present invention will be better understood with reference to FIGS. 1 through 8. After a player actuates the reset switch 13 and the sequence switch 15 in step 1 (this is referred to merely as SP 1 in FIG. 8), the memory switch 11 is turned ON in step 2. As a consequence, current flows through the light emitting diode 12 and the resistor 129 thereby energizing or firing the light emitting diode 12. Under these circumstances, whenever the manual switch 14 or the foot switch 22 is actuated, the waveforming circuit 104 provides the click signals for the waveforming circuit 106 which shapes the click signal to have a given pulse width and leads the resultant click signal as depicted in FIG. 7(A) from the click signal output terminal 107 to the first channel record signal input terminal CHI of the tape recorder 200, FIG. 3.

When a player actuates the record key 204, the tape recorder 200 assumes the recording and the magnetic tape starts moving. When this occurs and the player keeps actuating repeatedly the manual switch 14 or the foot switch 22 according to the rhythm of a music tune, the click signals characteristic of the rhythm of that tune are recorded in the first channel of the magnetic tape. The player continues to actuate the manual switch 14 or the foot switch 22 until playing the rhythm of that tune is completed whereupon the player actuates the rewind key 203 of the tape recorder 200 to thereby rewind the magnetic tape. Thereafter, the player actuates the play key 201 to place the tape recorder 200 into the play state wherein the click signals recorded on the magnetic tape are reproduced by the tape recorder 200. At the same time the player pushes the sequence switch 15 in step 3 to proceed to step 4 wherein the CPU 105 provides the signal for the interface 130, indicating that the data may be stored in the memory 114, whereby the light emitting diode 18 reading "STORE" is enabled.

The click signals reproduced by the tape recorder 200, on the other hand, are supplied from the reproduction signal output terminal of the tape recorder 200 to the audio signal input terminal 101 of the synchronizing signal generator 100. These click signals are shaped by the waveforming circuit 104 and applied to the CPU 105. The built-in clock counter 112 in the CPU 105 counts the clock signals from the clock oscillator 113 as depicted in FIG. 7(B) in step 5 in response to receipt of the click signals. The CPU 105 permits the count, for example, 960 in FIG. 7(C) of the clock counter 112 operating during the period of time of receipt of a particular one of the click signals to the time of the next succeeding click signal to be entered in the memory 114. This loading or entering is executed each time the click signal is received.

After reproduction of all of the click signals recorded on the magnetic tape the sequence switch 15 is actuated in step 6. With the advance toward step 7, the CPU 105 fetches the numeral data temporarily stored in the memory 114 and divides the data by a predetermined numeral value (for example 96). The result of the division (quotient), for example 10 (cf. FIG. 7(D)) is returned into the memory 114. Upon the completion of a sequence of the above described procedure the CPU 105 delivers the instruction to the interface 130 in step 8 so that the light emitting diode 18 reading "STORE" is disabled and the light emitting diode 21 reading "REWIND" is enabled to show to the player the necessity of rewinding of the tape.

When it is desired to execute the operations of the CPU 105 in steps 3 to 5 upon actuation of the sequence switch 15 concurrently with recording of the click signals on the tape, the reset switch 13 is depressed. After the memory switch 11 has been turned ON, the tape recorder 200 is activated for recording and the sequence switch 15 is depressed twice in succession. The result is that the light emitting diode 18 reading "STORE" is energized. Upon subsequent actuation of the manual switch 14, etc. the click signals are recorded on the magnetic tape and simultaneously the count is loaded into the memory 114.

As soon as the player realizes that the light emitting diode 21 is in its enabled state, he actuates the rewind key 203 to rewind the magnetic tape. If the sequence switch 15 is pushed in step 9, then the CPU 105 delivers the instruction to the interface 130 in step 10, disabling the diode 21 and enabling the light emitting diode 19 reading "RUN" for prompting the player to start operating the tape recorder 200. Therefore, the player checks whether the light emitting diode 19 is enabled and depresses the play key 201 to initiate the operation of the tape recorder 200. Consequently, the click signals are reproduced again from the tape recorder 200 and fed by way of the waveforming circuit 104 into the CPU 105. As soon as the CPU 105 decides in step 11 that the click signal has been applied, it permits the clock counter 112 to count the clock signals. The CPU 105 in step 12 compares the count of the clock counter 112 with the data (the quotient of the division as stated previously) contained within the memory 114 and, if both agree, supplies the output pulse signal thereof to the dividing counter 115.

In other words, the CPU 105 provides the output pulse signal thereof as depicted in FIG. 7(E) to the dividing counter 115 through the NOR gates 138 and 139 whenever ten clock signals as suggested (a value 10) in FIG. 7(D) are received. The dividing counter 115 therefore counts a total of 96 pulse signals during the length of time from receipt of that particular click signal to receipt of the next succeeding click signal. The dividing counter 115 also divides these pulse signals at a given division ratio. The pusle signals for the division are properly selected by the time base selector 116. For example, when the x48 divider output signal of the dividing counter 115 is selected, the 96 pulse signals are divided in half or by two and 48 pulse signals are therefore obtainable during the length of time from receipt of the particular click signal to the occurrence of the next click signal. In the case that the x24 divider output signal is selected, the 96 pulse signals are divided by 4 and 24 pulse signals are available during the length of time from receipt of the particular click signal through that of the next click signal. In other words, the dividing counter 115 delivers a desired number of the pulse signals between the two adjacent click signals, depending upon the multiple (x2 to x48).

A particular one of the divider output signals as selected by the time base selector 116 is supplied as the output pulse signal to the output terminal 120 through the buffer amplifier 119. The output pulse signal is therefore fed to the synchronizing signal input terminal 301 of the sequencer 300. As described with reference to FIGS. 4 and 5, the sequencer 300 produces the control voltage and the gate signals in synchronism with the output pulse signals delivered from the synchronizing signal generator 100 and supplies both the control voltage and the gate signals to the synthesizer 400. The music synthesizer 400 therefore produces the tone signals in synchronism with the tempo as determined by the output pulse signals from the synchronizing signal generator 100.

The tone signals are recorded on the second channel of the magnetic tape, for example, by the tape recorder 200. Assume now that all of the click signals recorded on the magnetic tape have been supplied to the CPU 105 through the waveforming circuit 104 and the pulse signals have been supplied into the dividing counter 115 in step 14 based on all of the data contained in the memory 114 or the sequence switch 15 has been actuated in step 13. When this occurs, the CPU 105 in step 15 delivers the instruction to the interface 130, disabling the light emitting diode 19 reading "RUN" and enabling the light emitting diode 20 reading "STOP" to prompt the player to stop the operation of the tape recorder 200.

In the case where there is not any need for changing the data previously stored, the memory switch 11 is turned OFF to prevent the data from disappearing and then the sequence switch 15 is actuated. As a result, the light emitting diode 20 goes out and the light emitting diode 21 lights up to demand the rewinding of the tape. Thereafter, if the player causes the rewinding of the magnetic tape and actuates the sequence switch 15, then the CPU 105 issues the instruction as in step 10 to thereby fire the light emitting diode 19. Should the magnetic tape start running in the tape recorder 200, the CPU 105 repeats the procedures in steps 11 and 12. When it is necessary to record the click signals again, the player should place the tape recorder 200 into the rewind state and then start recording while maintaining the memory switch 11 in the ON position. Upon the player's actuation of the sequence switch 15 it becomes possible to record the click signals through the aid of the manual switch 14, etc. The subsequent procedures are similar to those stated above.

The click signals recorded on the tape sometimes fail to meet timed relationship with the output signals from the CPU 105 due to slight variations in the travel speed of the tape or due to any other reason. In this case, it is possible to accelerate or decelerate the tempo of any given beat of the output signals (the pulse signals as shown in FIG. 7(E)) into the timed relationship by actuating the advance switch 16 or the retard switch 17. In other words, when it is desired to accelerate the tempo, the advance switch 16 should be depressed. With the advance switch 16 in closed position, the CPU 105 supplies the addition pulse signal as depicted in FIG. 7(F), to the dividing counter 115 through the AND gate 124 and the NOR gates 138 and 139. The addition pulse is delivered only once between the adjacent click signals when the output signal as indicated in FIG. 7(E) is at a "L" level. As a result, the dividing counter 115 is supplied with the output signals from the CPU 105 plus the addition pulse. This results in speeding up the division by the dividing counter 115 whereby the development of the divider output signals is accelerated. This leads to speed up of the tempo by one beat when the advance switch 16 is actuated once. It is clear that more than one addition pulses may be developed between the two adjacent click signals. In such a case the tempo of the beats may be further accelerated upon actuation of the advance switch 16.

On the other hand, when deceleration of the tempo is desired, the retard switch 17 should be depressed. With the retard switch 17 in closed contact position, the CPU 105 supplies the gate signal as indicated in FIG. 7(G) to the NOR gate 139 through the AND gate 122. The gate signal is a pulse signal that assumes a "H" level only when the output signal from the CPU 105 is initially at a "H" level between the two adjacent click signals. Accordingly, the gate signal eliminates the first pulse of the output signal so that the dividing counter 115 is supplied with the pulse signals short of one pulse. It is therefore possible to decelerate the division speed of the dividing counter 115 and slow down the tempo by one beat when the retard switch 17 is actuated.

More than one gate signal may be developed between the two adjacent click signals. This leads to further deceleration of the tempo when the retard switch 17 is actuated.

Since the retard switch 17 and the advance switch 16 make it possible to vary the tempo of the beats in this manner, the output pulse signals are available whose tempo is modified at any desired point.

Figure 9:
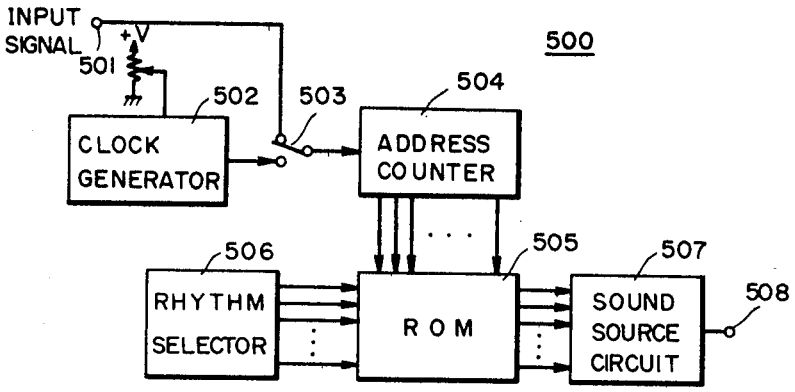
FIG. 9 is a schematic block diagram of an automatic rhythm generator as an example of electronic musical instruments.

FIG. 9 is a schematic block diagram of an automatic rhythm generator 500 as an example of electronic musical instruments. Implementations of the automatic rhythm generator 500 will be discussed with reference to FIG. 9. The output pulse signals from the synchronizing signal generator 100 are supplied to a signal input terminal 501. This signal input terminal 501 is connected to a contact terminal of a switch 503 of which the other terminal is connected to an output terminal of a clock generator 502. This embodiment is adapted such that the automatic rhythm generator 500 may produce rhythm sounds in response to the output pulse signals from the synchronizing signal generator 100 or in repsonse to the output pulse signals from the clock generator 502 by operating the switch 503. The output pulse signals from the synchronizing signal generator 100 as selected by the switch 503 are fed into an address counter 504. The address counter 504 counts the output pulse signals applied thereto and supplies an address signal to a ROM 505. The ROM 505 is constructed to store data corresponding to different kinds of rhythm sounds such swing and waltz. A rhythm selector 506 is connected to the ROM 505 to select any one of the different rhythms stored in the ROM 505. When a desired one of the rhythms is selected through the rhythm selector 506 and the ROM 505 is addressed by the address counter 504, the ROM 505 delivers the data corresponding to the selected rhythm to a sound source circuit 507. The sound source circuit 507 reproduces the rhythm sounds based upon the data delivered from the ROM 505.

Operation of the automatic rhythm generator 500 which receives the output pulse signals from the synchronizing signal generator 100 embodying the present invention will now be made clear with reference to FIGS. 2 and 9. The click signals are reproduced by the tape recorder 200 and supplied to the synchronizing signal generator 100 in the same manner as stated above. The output pulse signals from the synchronizing signal generator 100 are counted by the address counter 504. The counting output signal of the address counter 504 specifies the address of the ROM 505. When the desired rhythm is selected through the rhythm selector 506, the ROM 505 unloads the data corresponding to the selected rhythm into the sound source circuit 507. The sound source circuit 507 provides rhythm sound signals at its output terminal 508 in response to the data applied thereto. By applying the output pulse signals from the synchronizing signal generator 100 to the automatic rhythm generator 500 as the tempo clock signals in this manner, the rhythm sounds are available from the output terminal 508 of the automatic rhythm generator 500, which sounds are held in synchronism with the output pulse signals and accompany delicate variations in tempo.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A synchronizing signal generator comprising: an input terminal for applying pulse signals to said generator; clock signal generating means for generating clock signals; counting means (112) connected to said clock signal generating means for counting the clock signals from said clock signal generating means in synchronism with the pulse signals applied to said input terminal to provide a count of clock signals; signal dividing means (105) operatively connected to said counting means for dividing by a predetermined numeral value the number of the count of clock signals counted by said counting means during a length of time beginning when a particular one of said pulse signals is applied and ending when the next succeeding pulse signal is applied to provide a first quotient value; storing means (114) connected for storing at least either of said count of clock signals and the first quotient value representing the result of said division; and output signal means (115, 116, 119) operatively connected to said signal dividing means (105) for providing an output signal (at 120) when a certain coincidence condition is met, said certain coincidence condition occurring when the number of counted clock signals corresponds to said first quotient value fetched from said storing means through said signal dividing means or when the number of counted clock signals corresponds to the result of a further division providing a second quotient value fetched from said storing means.

2. The synchronizing signal generator as set forth in claim 1, wherein said output signal providing means include frequency dividing means for frequency dividing said output signal.

3. The synchronizing signal generator as set forth in claim 2, wherein said frequency dividing means include output terminals for providing a plurality of divided output signals resulting from different division ratios; and selecting means connected to said output terminals for selecting any one of said frequency divided output signals provided by the plurality of the output terminals of said frequency dividing means.

4. The synchronizing signal generator as set forth in claim 2 or 3, further comprising gate means for inhibiting a desired number of the output signals from being provided out of the output signals applied to said frequency dividing means.

5. The synchronizing signal generator as set forth in claim 2 or 3, further comprising pulse signal adding means for adding a desired number of the pulse signals to the output signals applied to said frequency dividing means.

6. The synchronizing signal generator as set forth in claim 1, further comprising pulse signal generating means for generating said pulse signals and applying said pulse signals to said input terminal.

7. The synchronizing signal generator as set forth in claim 6, wherein said pulse signal generating means include instructing means for instructing the generation of said pulse signals.

8. The synchronizing signal generator as set forth in claim 6, wherein said pulse signal generating means include means for receiving click signals and generating said pulse signals.

9. The synchronizing signal generator as set forth in claim 6, further comprising: magnetic recording means having a record mode and a reproduction mode for recording the pulse signals provided by said pulse signal generating means during said record mode and for reproducing the recorded pulse signals and applying the pulse signals as the click signals to said pulse signal generating means during said reproduction mode.

10. An electronic musical instrument comprising: a synchronizing signal generator including an input terminal for applying pulse signals to said signal generator; clock signal generating means for generating clock signals; counting means for counting the clock signals from said clock signal generating means in synchronism with the pulse signals applied to said input terminal to provide a count of clock signals; signal dividing means operatively connected to said counting means for dividing by a predetermined numeral value the number of the count of clock signals counted by said counting means during a length of time beginning when a particular one of said pulse signals is applied and ending when the next succeeding pulse signal is applied to provide a first quotient value; storing means connected for storing at least either of said count of clock signals and the first quotient value representing the result of said division; output signal means operatively connected to said signal dividing means for providing an output signal (at 120) when a certain coincidence condition is met, said certain coincidence condition occurring when the number of counted clock signals corresponds to said first quotient value fetched from said storing means through said signal dividing means or when the number of counted clock signals corresponds to the result of a further division providing a second quotient value fetched from said storing means; tempo clock signal generating means operatively connected to said output signal providing means for generating a desired number of tempo clock signals in response to the output signal from said output signal providing means, during said length of time; and sound generating means operatively connected to said tempo clock signal generating means for producing musical sounds in synchronism with the tempo clock signals from said tempo clock signal generating means.

11. The electronic musical instrument as set forth in claim 10, wherein said sound generating means include a sequencer and a music synthesizer, and wherein said sequencer includes: gate signal generating means for generating gate signals in synchronism with said tempo clock signals; control voltage generating means for generating a control voltage of a given amplitude between the gate signals from said gate signal generating means, and wherein said music synthesizer further includes means for delivering tone signals in response to the output of said gate signal generating means in said sequencer and in response to the output of said control voltage generating means.

12. The electronic musical instrument as set forth in claim 10, wherein said sound generating means comprise an automatic rhythm generator and wherein said automatic rhythm generator includes: rhythm pattern forming means for forming rhythm patterns; selecting means for selecting the rhythm patterns as formed by said rhythm pattern forming means; rhythm pattern signal providing means for providing rhythm pattern signals corresponding to the rhythm pattern selected by said selecting means, in response to said tempo clock signals; and rhythm sound producing means for producing rhythm sounds in response to the rhythm pattern signals provided by said rhythm pattern signal delivering means.

13. The electronic musical instrument as set forth in claim 10, wherein said tempo clock signal generating means include frequency dividing means for dividing the frequency of said output signals and for providing said desired number of the tempo clock signals.

14. The electonic musical instrument as set forth in claim 10, wherein said frequency dividing means include: output terminals which provide a plurality of divided output signals of different division ratios; and selecting means for selecting any one of said divided output signals provided by the plurality of the output terminals of said frequency dividing means and for obtaining said desired number of the tempo clock signals.

15. The electronic musical instrument as set forth in claim 13, wherein said tempo clock signal generating means include advance means for advancing the generation of said tempo clock signals.

16. The electronic musical instrument as set forth in claim 15, wherein said advance means include pulse signal adding means for adding a given number of the pulse signals to the output signals applied to said frequency dividing means.

17. The electronic musical instrument as set forth in claim 13, wherein said tempo clock signal generating means include retard means for retarding the generation of said tempo clock signals.

18. The electronic musical instrument as set forth in claim 17, wherein said retard means include gate means for inhibiting a given number of the output signals from being provided out of the output signals as applied to said frequency dividing means.

19. The electronic musical instrument as set forth in claim 10, further comprising pulse signal generating means for generating said pulse signals and applying said pulse signals to said input terminal.

20. The electronic musical instrument as set forth in claim 19, wherein said pulse signal generating means include instructing means for instructing the generation of said pulse signals.

21. The electronic musical instrument as set forth in claim 20, wherein said pulse signal generating means include recording means for recording said pulse signals, and wherein said recording means record the pulse signals delivered from said pulse signal generating means whenever the instruction is given by said instructing means.

22. The electronic musical instrument as set forth in claim 21, wherein said recording means include magnetic recording means having a record mode and a reproduction mode for recording the pulse signals provided by said pulse signal generating means in said record mode and for reproducing said pulse signals recorded in said reproduction mode.

* * * * *